US012569733B2

(12) United States Patent
Giokas

(10) Patent No.: US 12,569,733 B2
(45) Date of Patent: Mar. 10, 2026

(54) CLUB RACK FOR GOLF CART BAG

(71) Applicant: William J. Giokas, Wilbraham, MA (US)

(72) Inventor: William J. Giokas, Wilbraham, MA (US)

( * ) Notice: Subject to any disclaimer, the term of this patent is extended or adjusted under 35 U.S.C. 154(b) by 0 days.

(21) Appl. No.: 18/591,565

(22) Filed: Feb. 29, 2024

(65) Prior Publication Data

US 2025/0276221 A1 Sep. 4, 2025

(51) Int. Cl.
*A63B 55/10* (2006.01)
*A47B 81/00* (2006.01)

(52) U.S. Cl.
CPC ..... *A63B 55/10* (2013.01); *A47B 81/00* (2013.01); *A47B 81/005* (2013.01)

(58) Field of Classification Search
CPC ..... A63B 55/10; A47B 81/00; A47B 81/005
USPC ..... 211/70.2
See application file for complete search history.

(56) References Cited

U.S. PATENT DOCUMENTS 699,391 A * 5/1902 Johnson ..... A63B 55/10 294/146
1,418,093 A * 5/1922 Parmater ..... A63B 55/10 280/DIG. 6
1,575,023 A * 3/1926 Walton ..... A63B 55/10 473/282
1,661,500 A * 3/1928 Reach ..... A63B 55/10 473/282
1,696,062 A * 12/1928 Thurlow ..... A63B 55/10 294/143
1,719,360 A * 7/1929 Deike ..... A63B 55/10 211/70.2
2,024,484 A * 12/1935 Smith ..... A63B 55/10 280/DIG. 6
2,419,175 A * 4/1947 Spohrer ..... A63B 55/10 211/89.01
2,597,386 A * 5/1952 Schmid ..... A63B 55/60 280/DIG. 6
3,154,314 A * 10/1964 Mccune, Jr. ..... B62B 1/262 280/DIG. 6
3,172,585 A * 3/1965 Mahaney ..... A63B 55/10 294/166
3,531,136 A * 9/1970 Mobley ..... B62B 1/14 280/DIG. 6

(Continued)

FOREIGN PATENT DOCUMENTS

CA 2221080 A1 * 7/1999 ..... A63B 55/00
DE 19900252 C1 * 1/2000 ..... A63B 55/10

(Continued)

*Primary Examiner* — Stanton L Krycinski

(57) ABSTRACT

This club rack ("RACK") is designed for use primarily by golfers who have limited shoulder motion and have difficulty in lifting golf clubs out of a golf bag. It is designed to minimize the motion required to use a golf club AND to easily be used with a golf bag mounted on a motorized golf cart. The RACK is a single piece non-metallic assembly consisting of a vertical bracket and two horizontal shelves and designed to hold up to 8 clubs. Once the golf bag is placed on the cart, the rack is placed in front of the bag so that the bottom portion of the vertical bracket extends beneath the front lip of the bag well of the cart. The golf bag and RACK are then both secured to the cart using the strap that is part of the cart.

7 Claims, 4 Drawing Sheets

(56) References Cited

U.S. PATENT DOCUMENTS

D222,720 S * 12/1971 Lapham et al. ..... 294/143
3,826,378 A * 7/1974 Novak ..... A47B 49/004 211/70.5
3,954,239 A * 5/1976 Kerbs, Jr. ..... A63B 55/10 294/146
4,523,403 A * 6/1985 Ivy ..... A01K 97/125 43/17
4,666,038 A * 5/1987 Minneman ..... A63B 55/10 211/198
4,673,082 A * 6/1987 Hemme ..... A63B 55/40 280/DIG. 6
4,753,446 A * 6/1988 Mills ..... A63B 55/00 280/DIG. 6
4,852,896 A * 8/1989 Mills ..... A63B 55/60 280/DIG. 6
5,069,481 A * 12/1991 Strange ..... B62J 11/00 D12/16
5,072,539 A * 12/1991 Greenberg ..... A01K 97/10 211/70.2
5,417,334 A * 5/1995 Wu ..... A63B 55/20 248/156
5,626,379 A * 5/1997 Scott ..... A47B 81/005 211/195
5,730,285 A * 3/1998 Sheehan ..... A63B 55/40 206/315.6
5,738,229 A * 4/1998 Fairweather ..... A47F 7/0028 211/70.2
5,829,604 A * 11/1998 Brophy ..... A63B 55/40 211/85.7
5,918,490 A * 7/1999 Lion ..... A63B 55/408 206/315.3
6,142,319 A * 11/2000 Kim ..... A63B 55/00 206/315.6
7,281,398 B1 * 10/2007 Sims ..... A63B 55/40 70/64
7,284,659 B2 * 10/2007 Sugarek ..... A63B 55/10 206/315.6
7,337,898 B2 * 3/2008 Lewter ..... A63B 55/60 206/315.6
D659,788 S * 5/2012 VanNostran ..... D21/796
10,058,750 B2 * 8/2018 Weiss ..... A45C 13/30
10,099,098 B2 * 10/2018 Snyder ..... A63B 55/10
D934,587 S * 11/2021 Crawford ..... A01K 97/10 D6/552
2004/0016711 A1 * 1/2004 Burrows ..... A63B 55/10 211/70.2
2011/0215013 A1 * 9/2011 Young ..... A63B 57/207 473/282
2018/0361212 A1 * 12/2018 Morton ..... A63B 55/40
2022/0233926 A1 * 7/2022 McDonald ..... A47G 33/06

FOREIGN PATENT DOCUMENTS

FR 2981578 A3 * 4/2013 ..... A63B 55/00
WO WO-03101825 A1 * 12/2003 ..... A01K 97/08

* cited by examiner

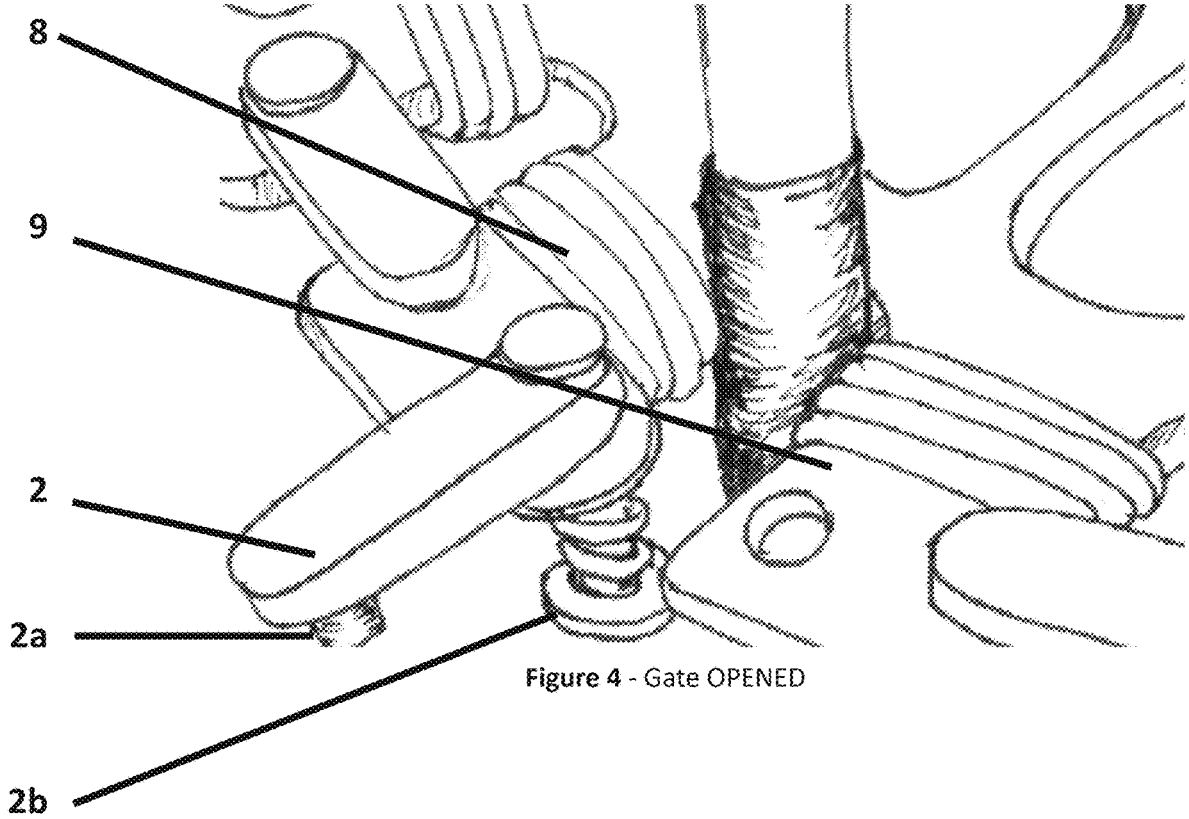
Figure 4 - Gate OPENED
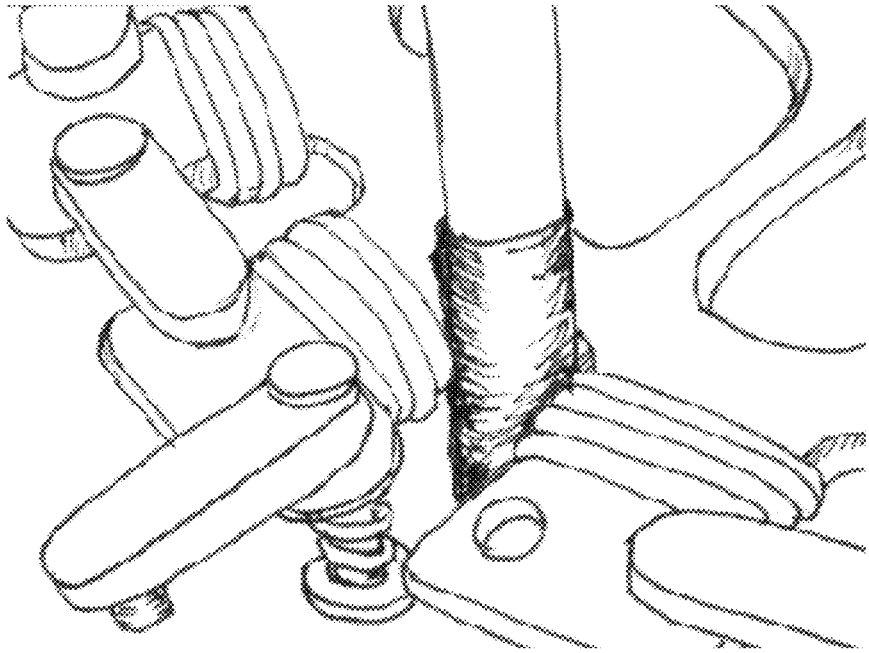
Figure 5 - Gate CLOSED

CLUB RACK FOR GOLF CART BAG

BACKGROUND OF THE INVENTION

Many golfers use a motorized golf cart to play golf. Their golf bag is mounted to the cart by placing the bottom of the bag into a well at the rear of the cart and then using the cart strap to secure the upper portion of the golf bag to the cart. The golf bag holds the golf clubs, balls, tees, gloves as well as rainwear, lotions and other items the golfer choses. Most carts are designed for 2 golfers and 2 sets of clubs.

Golfers afflicted with arthritic shoulders and/or torn muscles find it difficult to remove and replace a club from the bag because to do so the club must be raised or lowered the full length of the golf bag. This requires expending a considerable effort and time for golfers with limited vertical shoulder motion.

SUMMARY OF THE INVENTION

This club rack ("RACK") is designed for use primarily by golfers who have limited shoulder motion and have difficulty in lifting golf clubs out of a golf bag. It is designed to minimize the motion required to use a golf club, and to easily be used with a golf bag mounted on a motorized golf cart.

The RACK is a single piece non-metallic assembly consisting of a vertical bracket and two horizontal shelves, and designed to hold up to 8 clubs. Once the golf bag is placed on the cart, the rack is placed in front of the bag so that the bottom portion of the vertical bracket extends beneath the front lip of the bag well of the cart. The golf bag and RACK are then both secured to the cart using the strap that is part of the cart.

BRIEF DESCRIPTION OF THE DRAWINGS

The present invention is depicted in the drawings as follows:

FIG. 4 is a close-up view of the shaft of a club in the Slot with the Gate opened.

FIG. 5 is a close-up view showing the Gate closed.

DETAILED DESCRIPTION OF THE INVENTION

Figure 1:
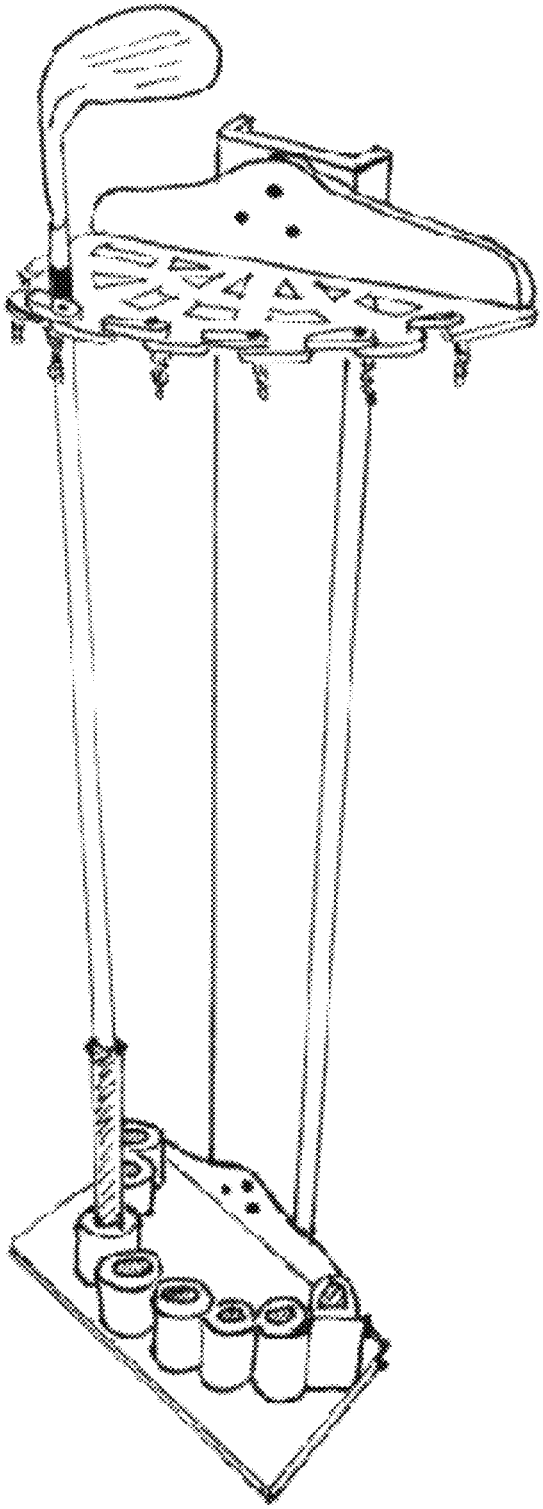
FIG. 1 is a full view of the present invention (rack) and showing a single golf club positioned in the rack.

The specific components of the Club Rack for Golf Cart Bag ("RACK") are shown in FIG. 1. The TOP Shelf (1) and BOTTOM shelf (4) are assembled to the front side of the Vertical Bracket (3). The head end of a golf club is shown positioned in a slot on the TOP Shelf with the GATE (2) closed and the grip end positioned in the corresponding HOLDER (5) on the BOTTOM Shelf.

Figure 2:
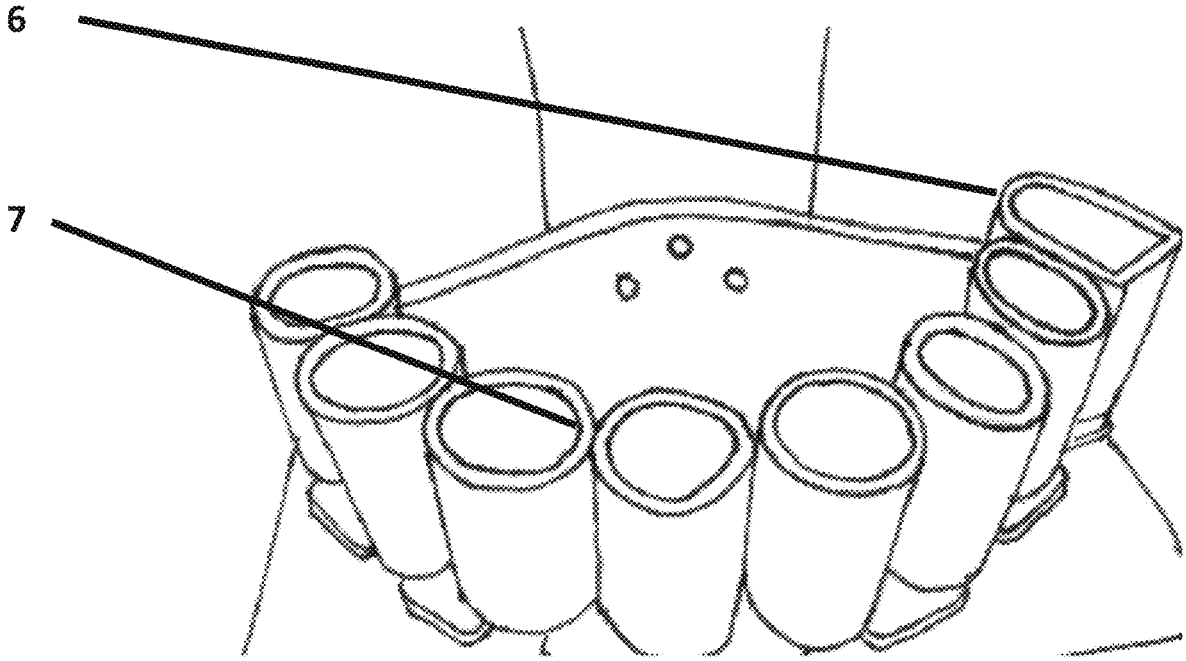
FIG. 2 shows the Bottom Shelf of the rack with the eight Holders for the handle end of the golf clubs.

The HOLDERS (7 & 6) are designed so that the club handle will not bounce out as the golf cart travels along the course. FIG. 2 illustrates the seven non-metallic tubes HOLDERS (7) and an eighth oblong shaped HOLDER (6) to accommodate the different shape grips on most type of putters in use today. The bottom end of each HOLDER is a closed end and used to assemble the HOLDER to the BOTTOM Shelf. The top of each HOLDER is open so the grip end of a golf club can be slid into the HOLDER.

Figure 3:
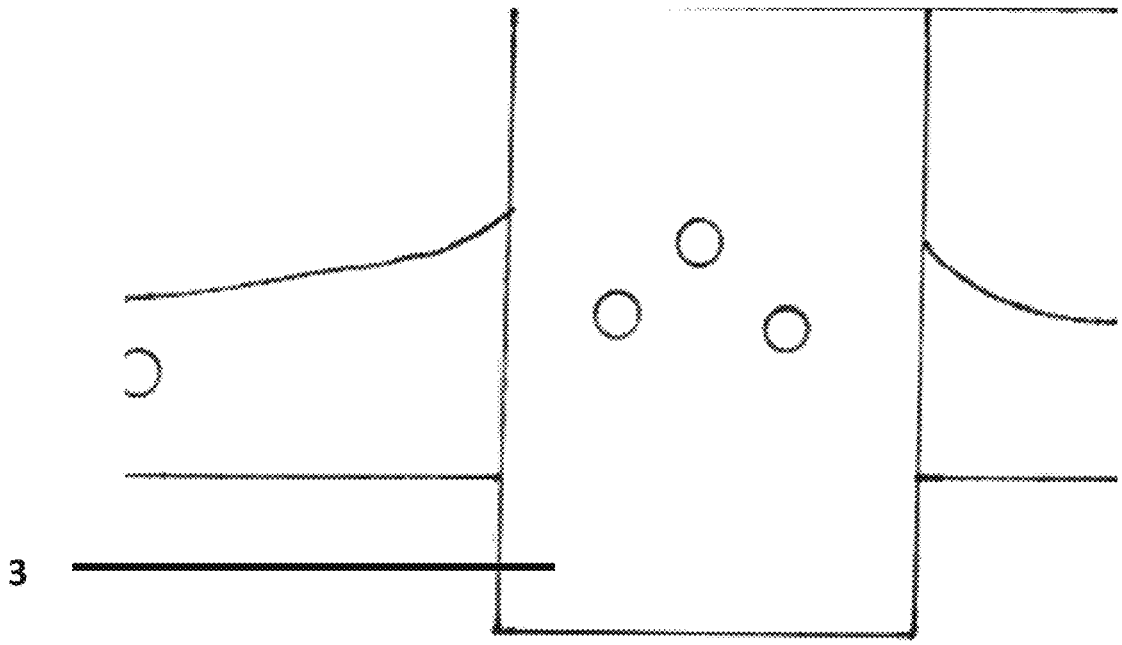
FIG. 3 shows the orientation of the Bottom Shelf to the Vertical Bracket.

As shown in FIG. 3, the BOTTOM Shelf is assembled to the Vertical Bracket (3) so that the BOTTOM shelf will sit on the top of the front lip of the bag well of a typical golf cart and so that the Vertical Bracket will extend below the top of the lip. This element of the design retains the bottom end of the RACK against the lower portion of the golf club bag. The main strap which is part of a typical golf cart is used to retain the upper portions of both the golf club bag and the RACK to the golf cart. Thus the RACK can be quickly and easily attached to the golf club bag.

FIG. 4 is a close-up view of the TOP Shelf with the shaft of a golf club placed in the rounded part of a SLOT (9) and with the GATE (2) opened to allow removal of the club. The edges of rounded part of each slot are partially lined with a soft rubber material (8) to dampen any motion of the club while the golf cart is in motion. The GATE has a rotating spring loaded shaft (2*b*) on one end and a fixed stud (2*a*) on the other end. The GATE is positioned by pressing up on the bottom end of the spring loaded shaft and moving the GATE to either the open or closed position.

FIG. 5 illustrates how the club is held in the SLOT when the GATE is closed. With the GATE closed, the fixed stud (FIG. 4 2*a*) is secured in a hole on the TOP Shelf. This design ensures that the golf club will be "locked" in place when the GATE is closed and prevents the club from sliding out of the SLOT accidentally during jostling occurring when the cart is in motion.

To withdraw a club from the RACK, the golfer opens the GATE, lifts the club no more than 3 inches by lifting the grip end of the club out of the HOLDER, then tilts the club shaft out of the SLOT. To replace the club, the golfer guides the grip end of the club into the HOLDER, slides the shaft into the corresponding slot and closes the GATE. Both of these actions require considerably less arm movement than removing or replacing a club from a standard golf bag.

Figure 6:
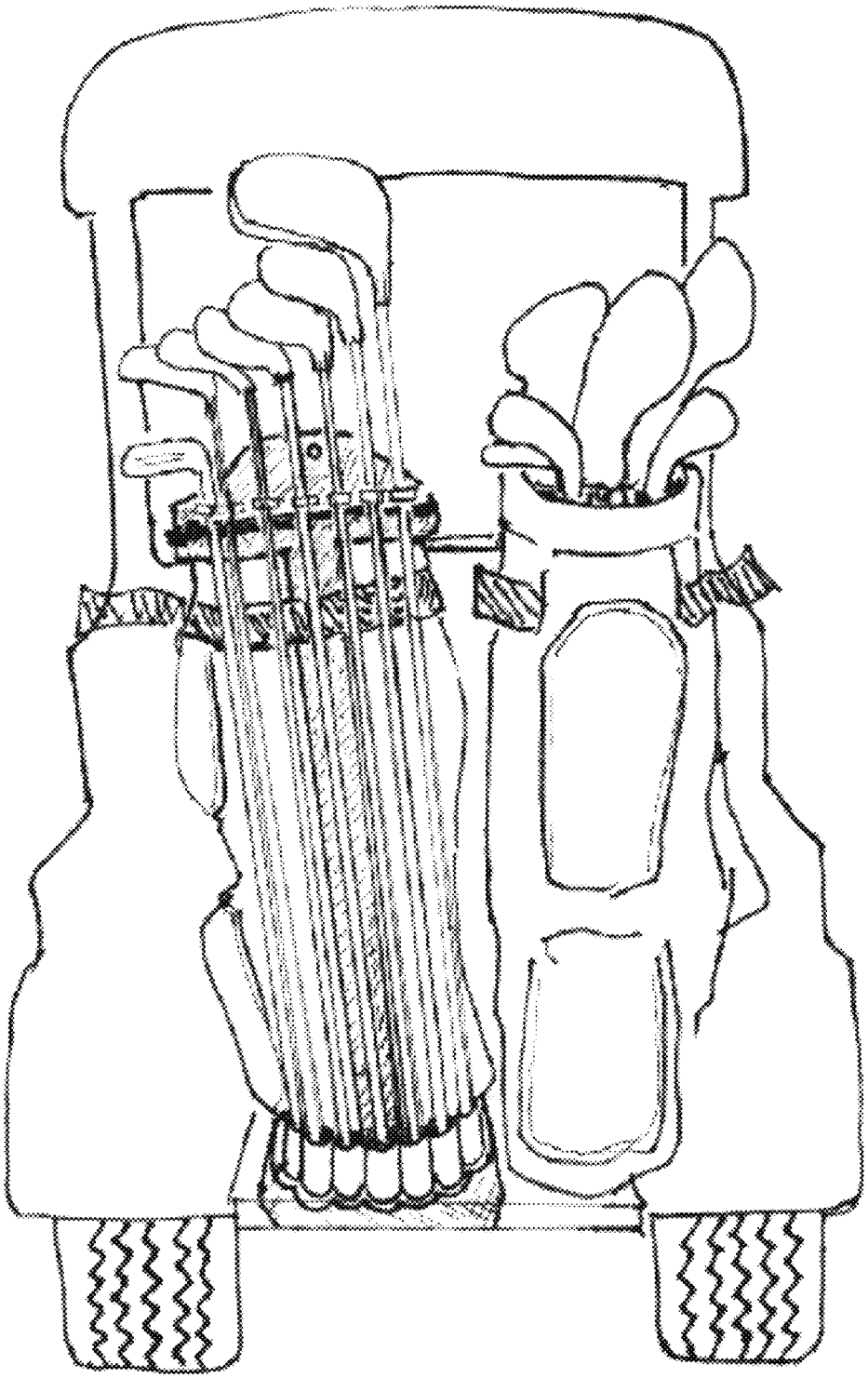
FIG. 6 shows the rear of a golf cart with a rack mounted to one of the two bags on the cart.

FIG. 6 shows the RACK mounted to one of the two golf bags on a golf cart. It illustrates that there is access to the golf bag.

The invention claimed is:

1. A golf rack for securely holding up to eight golf clubs and configured to be used with a golf bag on a motorized golf cart, the golf rack comprising:

an elongated vertical bracket, a semi-circular top shelf assembled to an upper portion of the vertical bracket, and a bottom shelf assembled to a bottom portion of the vertical bracket;

the top shelf comprising a plurality of slots each having an open end on an outside edge of said top shelf and terminating in a rounded shape configured to accept a shaft portion of a respective one of the golf clubs;

each slot having a rotatable gate configured to be positioned away from the slot to insert or remove the golf club through the slot and to be repositioned across the slot to prevent the golf club from sliding out of the slot during movement of the golf cart;

each gate having a rotatable spring loaded shaft on a first end and a fixed stud on a second end configured to be secured in a respective hole on the top shelf to lock the golf club in the slot;

the bottom shelf comprising a plurality of tubular holders each vertically aligned with a respective one of the slots, the holders including a plurality of cylindrical holders configured to hold a grip of a respective one of the golf clubs and a holder having a non-circular shaped cross-section configured to hold different shaped grips of a putter; and the golf rack configured to be mounted to the exterior of the golf bag using a belt that is used to mount the golf bag to the motorized golf cart.

2. The golf rack of claim 1, wherein each slot is partially lined with a rubber material on an edge of the rounded shape to dampen motion of the golf club during movement of the golf cart.

3. The golf rack of claim 1, wherein the golf rack comprises a non-metallic material, and/or the plurality of holders comprise a non-metallic material.

4. The golf rack of claim 1, wherein the holder having a non-circular shaped cross-section is oblong shaped.

5. The golf rack of claim 1, wherein each slot narrows from the outside edge of the top shelf towards the rounded shape to accommodate golf club shafts having different diameters.

6. The golf rack of claim 1, wherein the bottom shelf is positioned vertically from a bottom edge of the vertical bracket, such that the bottom shelf is configured to sit on a top of a front lip of a bag well of the golf cart with the bottom edge extending below the lip to retain the golf rack against a lower portion of the golf bag.

7. The golf rack of claim 1, wherein each golf club is configured to be removed from the golf rack by lifting the golf club no more than 3 inches, and tilting the shaft portion of the golf club out of the slot.

* * * * *